United States Patent [19]

Reisner

[11] Patent Number: 4,992,657

[45] Date of Patent: Feb. 12, 1991

[54] APPARATUS FOR DETECTING THE CUTTING HORIZON FOR MINING MACHINES

[75] Inventor: Günter Reisner, Wachtendonk, Fed. Rep. of Germany

[73] Assignee: Ruhrkohle Aktiengesellschaft, Fed. Rep. of Germany

[21] Appl. No.: 284,337

[22] Filed: Dec. 14, 1988

[51] Int. Cl.[5] ..... G01J 5/04

[52] U.S. Cl. ..... 250/253; 250/261; 250/269; 250/339

[58] Field of Search ..... 250/253, 261, 269, 339, 250/343

[56] References Cited

U.S. PATENT DOCUMENTS

| | | | |
|---|---|---|---|
| 4,034,218 | 7/1977 | Turcotte | 250/253 X |
| 4,045,676 | 8/1977 | Rolle | 250/253 X |
| 4,143,552 | 3/1979 | Godfrey | 299/1 |
| 4,165,460 | 8/1979 | Rose et al. | 250/253 X |
| 4,266,878 | 5/1981 | Auer | 250/339 X |
| 4,434,364 | 2/1984 | Correa et al. | 250/253 |
| 4,481,418 | 11/1984 | Vanzetti et al. | 250/341 X |
| 4,655,082 | 4/1987 | Peterson | 73/594 |
| 4,753,484 | 6/1988 | Stolarczyk et al. | 299/1 |

FOREIGN PATENT DOCUMENTS 3509868 10/1985 Fed. Rep. of Germany .

*Primary Examiner*—Constantine Hannaher
*Assistant Examiner*—Jacob Eisenberg
*Attorney, Agent, or Firm*—Thomas S. Baker, Jr.

[57] ABSTRACT

The cutting horizon for mining machines, such as coal ploughs and roll loaders, in particular the position of the coal-rock interlayer, can be determined with the aid of light signals of selected wavelengths at reflection layers, at least one sensor head guiding dragging along the floor and having at least one optical waveguide bundle constructed as measured-value pickup and guided in a passage sealed with a crystal window being arranged on the mining machine and a transmitted and receiving station being arranged on the machine body. For clear identification of the carbon-rock interlayer the passage (6) receiving the optical waveguide bundles (5,5') extends in the exit of the sensor head (3) at an angle of 30° and the lower surface (13) of the crystal window (7) extends parallel to the floor (2).

18 Claims, 4 Drawing Sheets

Figure 1:
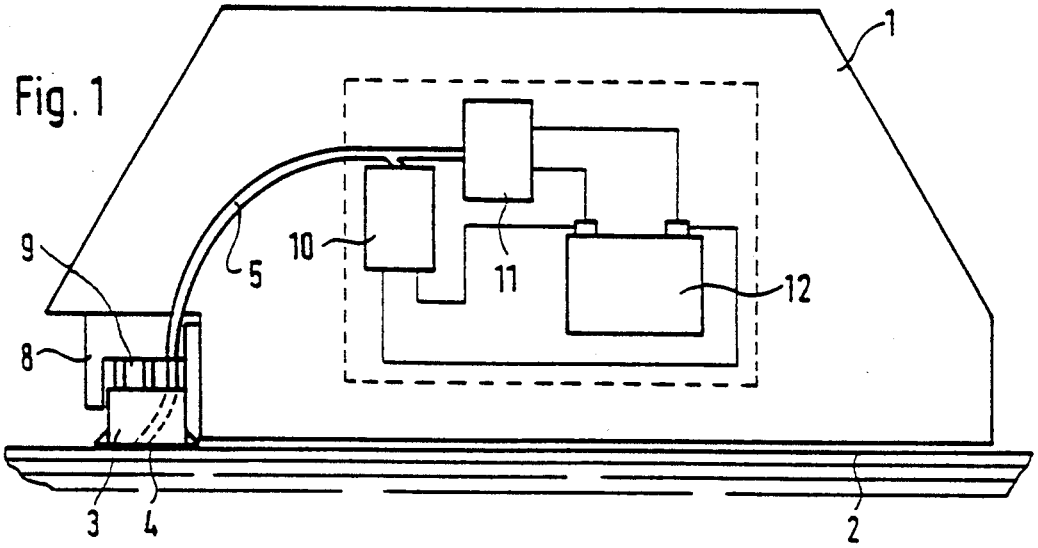

Fig. 3
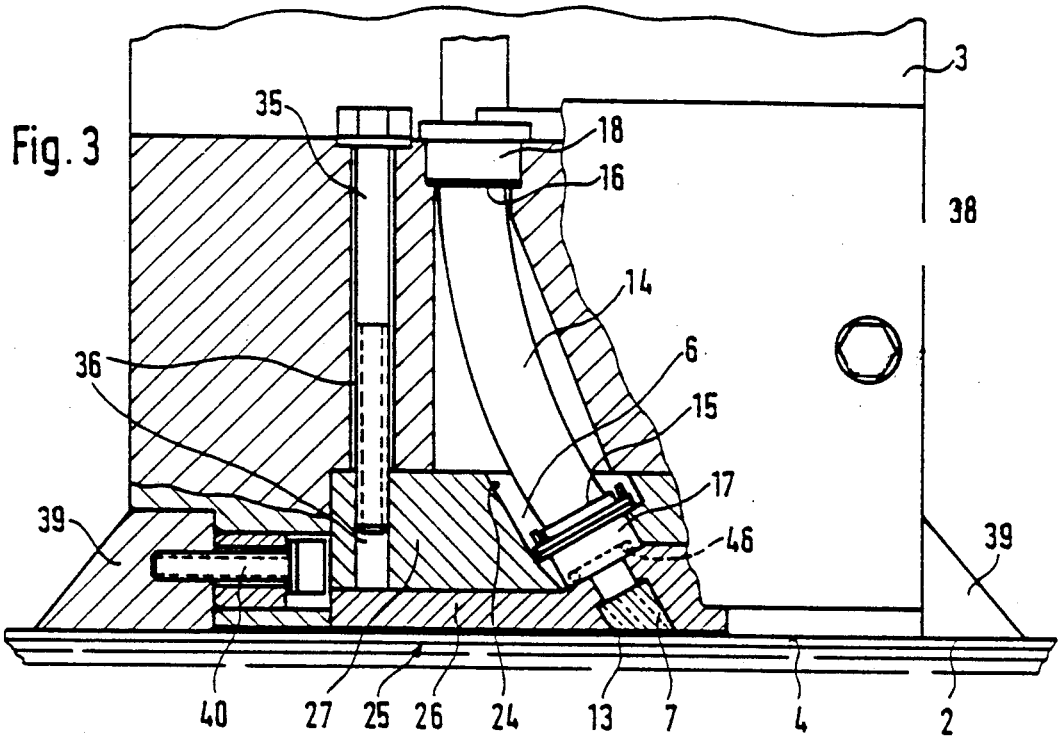
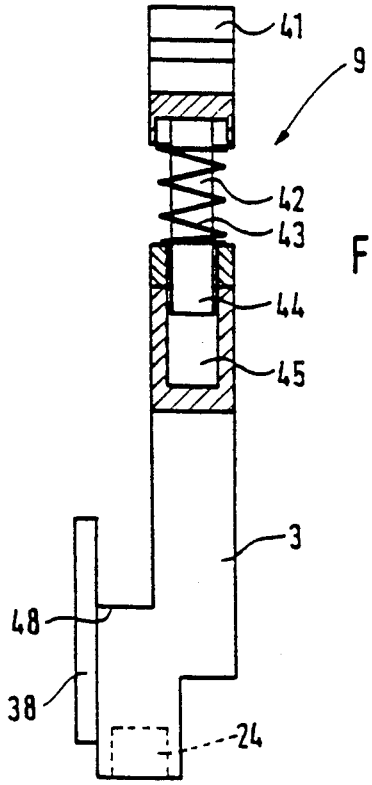
Fig. 4

APPARATUS FOR DETECTING THE CUTTING HORIZON FOR MINING MACHINES

The invention relates to an apparatus for detecting the cutting horizon for mining machines, such as coal ploughs and roll loaders more particularly, the invention detects the position of the coal-rock interface with the aid of light signals of selected wavelengths at reflection surfaces. The apparatus has at least one sensor head guided and dragged along the floor, at least one optical waveguide bundle constructed as a measured value pickup and guided in a passage sealed with a crystal window arranged on the mining machine and a transmitter and receiver station arranged on the machine body.

According to German patent No. 3,509,868 an automatic control for the vertically adjustable cutters of a coal plough is described in detail. The device uses at least one measured value pickup such that the coal-rock interface is detected with pulsed light and the different reflection properties of coal and ground rock utilized to control the position of tools. The measuring probes located in the sensor head and dragged over the floor are formed by the ends of optical waveguide bundles which are provided with a light transmitter and a light receiver. The optical waveguide bundles are embedded in a fixed ceramic layer in the sensor head and extend up to the outer surface of a ceramic body.

Although the tests based on reflection measurements of coal and floor rock, in particular using selected wavelengths, gave clearly apparent and easily differentiable measuring results sufficient for an appropriate control, practical experiments failed. These failures occurred because as the sensor head was dragged over specimens on a measuring bench containing concreted-in coal and floor rock, the optical waveguide bundles embedded therein in a ceramic plate buckled and bent, due to wear of the sensor head bottom. The resulting bending and buckling of individual waveguide fibers cause erratic values to be given which did not permit clear identification of the cutting horizon.

It is apparent a report of the DE research project "Measuring system for coal ploughs", intermediate report for the period from Jan. 1, 1987 to Mar. 31, 1987, for Ruhrkohle AG, Batelle Institute, in Frankfurt am Main, 4. 1987 "Arbeitspaket 4000", pages 10 and 11, that the erratic values caused by wear of the optical waveguide fibers could be reduced to obtain better identification if said fibers were sealed with an optical window in the form of a sapphire crystal inasmuch as the crystal window withstood the mechanical stresses occurring in being dragged over coal and adjacent rock.

However, the use of a sapphire crystal window did not give clear results when carrying out tests due to retroreflected radiation components from the inlet and exit surface of the crystal window. These components caused signals of the direct reflections from the inlet and exit surface of sapphire crystal to be greater than the measuring signals from the coal and rock beneath the sapphire crystal.

The present invention is now based on the problem of providing an apparatus for detecting the cutting horizon for mining machines such as coal ploughs and roll loaders which on the basis of the radiation components which reach the receiving fibers from the coal and rock permits a clear identification of the coal-rock interface.

This problem is solved according to the invention in that the passage receiving the optical waveguide bundle extends in the exit of the sensor head at an angle of 30 degrees and the lower surface of the crystal window extends parallel to the floor. Within the scope of functionability of the apparatus according to the invention an angle of 20 to 45 degrees appears possible.

On the basis of the spectral behaviour of coal and adjacent rock a theoretical ratio of the measured values at 850 nm and 1500 nm is obtained and a clear distinction is achieved.

Within the scope of the invention other wavelength combinations are also conceivable. For the preselected wavelengths high-power light sources are provided, for instance a light-emitting diode (LED) and a laser diode or a laser diode. Another advantage of these wavelengths is that water represents for these wavelengths an optical window and thus moisture has no influence on the measurements.

The sapphire selected for the window has the advantage that in the region of the measuring wavelengths it is optically transparent and due to its hardness can withstand high mechanical loads. The transmission of the light to the floor from the light sources is via a two-armed optical waveguide bundle. At the end of the optical waveguide bundles facing the floor there is the optical window. The components of the transmitted radiation reflected by the floor are collected again by the individual fibers of the receiver arm. It is found particularly advantageous within the scope of the invention for the guiding of the optical waveguide bundles to arrange the latter over the entire length in a flexible sheath and at the ends of the sheath provide plug-type inserts in which the optical waveguide bundles terminate in the form of eyes The optical waveguide bundles made up of a plurality of individual fibers with a diameter for example of 70 $\mu$m terminate at the upper side of the upper plug-type insert on the transmitter side for the wavelengths to be used of 850 nm and 1550 nm in two eyes, and in said plug-type insert a further eye is provided for the receiving arm of the optical waveguide bundles. A particular advantage is further to be seen in that the individual fibers of the optical waveguide bundles employed for two wavelengths of 850 and 1550 nm as a transmitter arm are statistically mixed, bundled to form a branch, and at the lower side of the plug-type insert directed towards the floor form an eye about which the individual fibers of the receiving arm are concentrically disposed.

The optical waveguide bundles bear flush on the lower side of the lower plug-type insert on the inner side of the sapphire window. The optical waveguide fiber bundle disposed on the side towards the power unit with two transmitting arms, one arm for each wavelength, unites at the contact surface to the inner side of the sapphire window to form one transmitting arm. The individual fibers of the transmitting arms are arranged statistically mixed in the center.

The individual fibers of the receiving arm surround the transmitting arm concentrically. With this arrangement a more punctiform exit of the transmission radiation and a proportional uniform reflection radiation of the two wavelengths is supplied to the receiving arm. To keep the radiation component reflected directly from the inlet and exit surface of the sapphire crystal relatively small said sapphire crystal is ground at its outside at an angle of about 30 degrees with respect to its inside.

Since according to the laws of optics the angle of incidence is equal to the angle of emergence, the greater part of the reflection from the emergence side of the sapphire crystal, which of course is not to be detected, is not collected by the fibers of the receiving arm, but only the diffuse components thereof. However, equal amounts of the transmitted radiation of the two wavelengths are reflected by carbon and adjacent rock and picked up by the receiving arm. If the diffused reflection from the emergence and incidence face of the sapphire crystal are inserted as constant and the ratio of the desired measuring signal from carbon and adjacent rock at 850 nm and 1550 nm formed, an evaluatable signal, the ratio value, is obtained as follows:

$$\text{Ratio} = \frac{\text{measuring signal 850 nm} - \text{scattering level 850 nm}}{\text{measuring signal 1550 nm} - \text{scattering level 1550 nm}}$$

The magnitude of the scattering level depends primarily on the surface quality of the crystal window. For this reason the crystal window comprises on the side accommodating the eye and the side wiping over the floor in each case a ground and polished surface. The necessary transmitter and receiver unit is installed on the plough body in corresponding free spaces. The sensor head is secured in the lower guide of the so-called wobble head and pressed against the floor via a spring system. To enable the horizontal and vertical movements necessarily occurring during the ploughing to be compensated with the sensor head the latter must be pressed onto the floor. Natural oscillations of the sensor head due to the springs must not occur. For this reason between the sensor head and the sensor head holder in the travelling direction a plurality of guide pins, for example three, are provided adjacent to each other and surrounded by biasing springs guided with their ends in bores of the sensor head. The respective necessary biasing force or spring action depends on the clearance in the ploughing apparatus because the vertical and horizontal movements of the plough are changed thereby.

According to the invention in the end face of the sensor a measuring insert is interchangeably disposed which receives apart from the crystal window also the plug-type insert for the optical waveguide bundle disposed in a flexible sheath The measuring insert is advantageously divided into two parts and consists of the wear plate guided on the floor and the wear plate holder In this manner it is possible to replace when required the wear plate, which is subject to considerable wear. Within the wear plate holder the plug-type insert or the end of the sheath is fixed by a specifically designed form flange in its seat in such a manner that the optical waveguide bundle always lies exactly on the inner face of the crystal window. An O ring ensures hermetic sealing against dust between the contact face of the eye receiving the optical waveguide bundle and the crystal window.

The gap-free sealing face between the wear plate and the wear plate holder is achieved by a particular form of said parts of the measuring insert. The connecting screws for connecting the two parts of the measuring inserts are located at unloaded states of the measuring insert. A comparable connection is provided also for locking the measuring insert in the sensor head.

A further advantage for the functionability of the sensor head is to be seen in that at both sides of the sensor head lying towards the respective travelling direction scavenging shoes connectable detachably to the sensor head are articulately mounted. Said scavenging shoes prevent during the travelling between the end face of the sensor head and the reflecting bottom a coal film from being rolled onto the floor and thus preventing exact identification of the horizon. The scavenging shoes are accommodated in form-locking manner in the sensor head and are held by screws which are inserted or screwed into the recess provided for the measuring insert.

The technical advance of the invention resides substantially in that based on the reflection properties of coal and rock a clear identification of the interface is possible, which is of immense importance with regard to the possibility of also cutting unnecessary rock layers or gathering them.

The identification concerns not only the exact determination of the interface coal/floor rock but could also be used for identification of coal and roof rock or incorporated dirt parting or bands.

An example of embodiment of the invention is illustrated in the drawings and will be explained in detail hereinafter.

Figure 2:
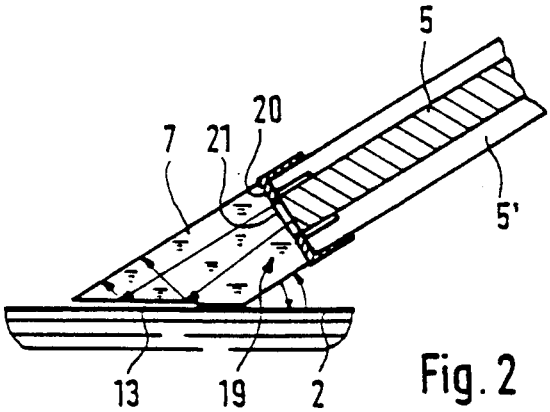
Figure 5:
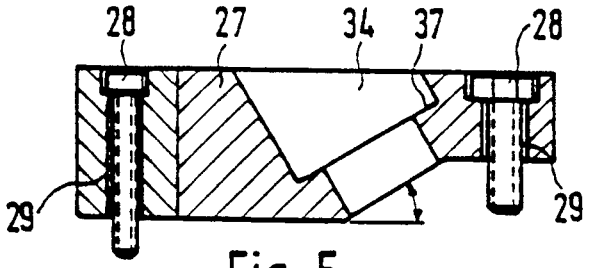
Figure 6:
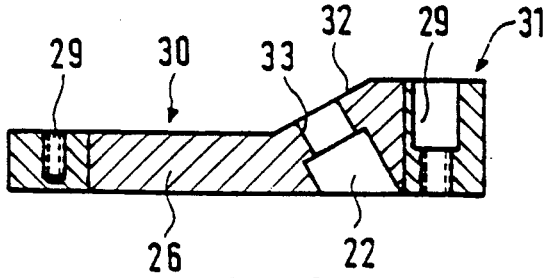
Figure 7:
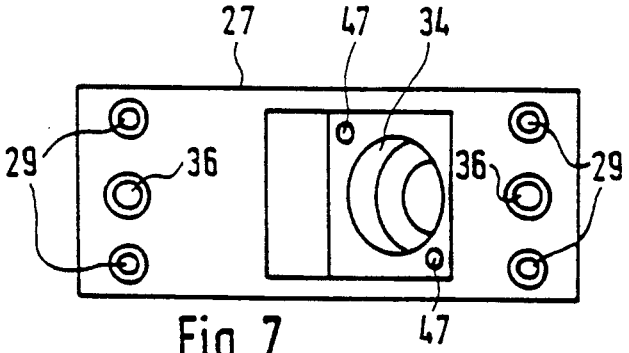
Figure 8:
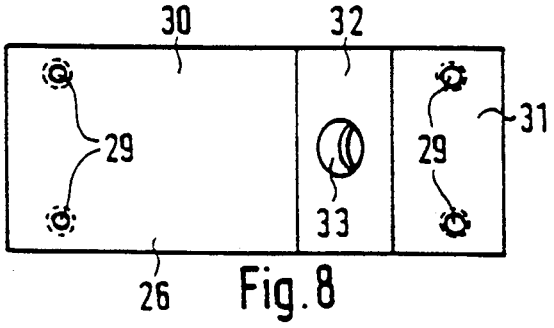
Figure 9:
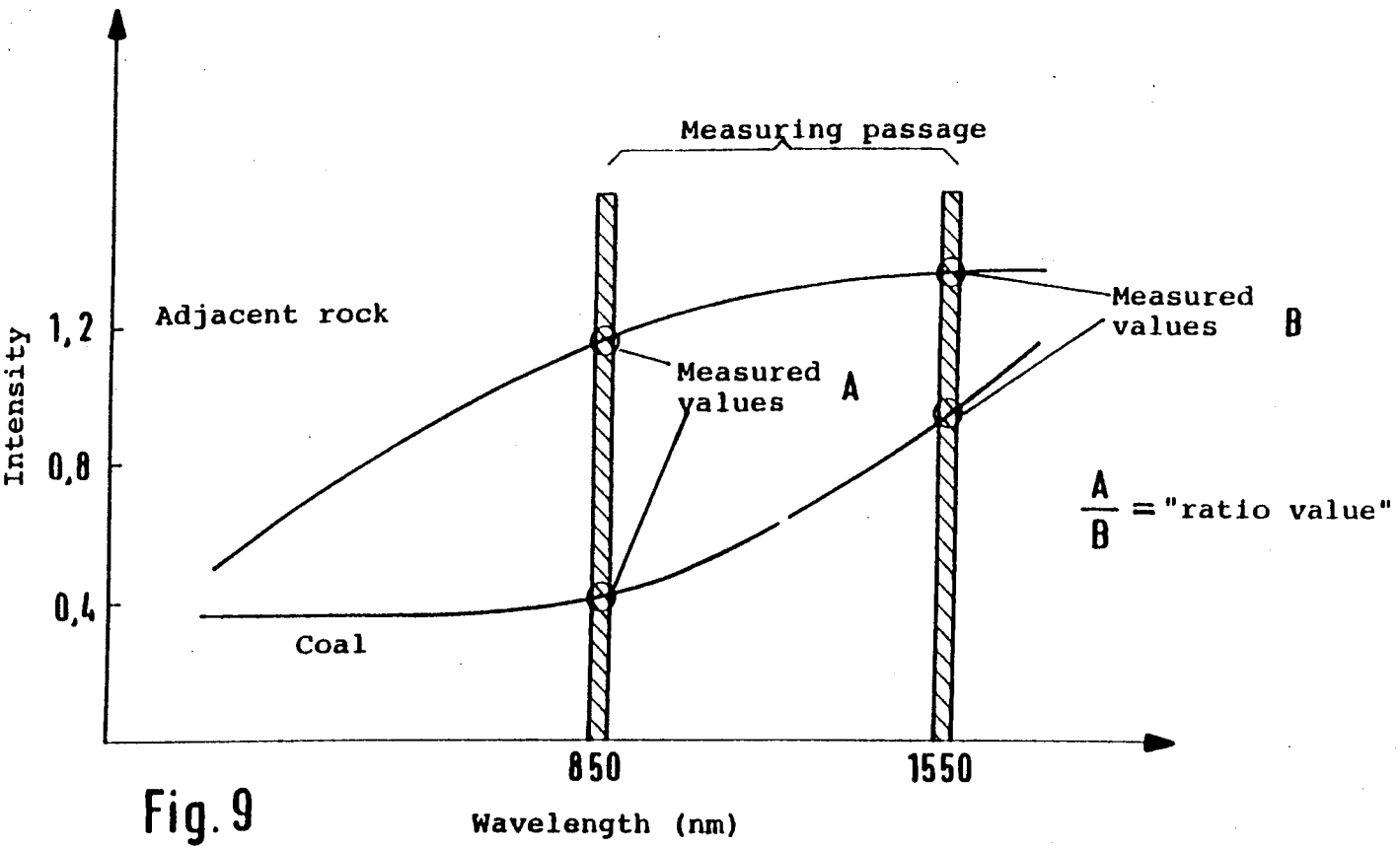

In the drawings:

FIG. 1 is a partial schematic side elevation of a coal plough in conjunction with a dragged sensor head, FIG. 2 is a basic sketch of the optical waveguide bundles terminating at a specific angle in connection with the crystal window, FIG. 3 is a partially sectioned view of a sensor head, FIG. 4 is a side elevation of the sensor head in conjunction with a sensor head holder, FIG. 5 is a side elevation of the wear plate holder in section, FIG. 6 is a side elevation of the wear plate in section, FIG. 7 is a plan view of the wear plate holder, FIG. 8 is a plan view of the wear plate and FIG. 9 is a diagram of the reflection behaviour of coal/adjacent rock taking account of the wavelengths selected.

The coal plough 1 shown in FIG. 1 as example of embodiment and only partially illustrated comprises on one side directed towards the floor 2 a sensor head 3 in a schematically indicated guide 8. The sensor head 3 is entrained by means of a spring element 9 in wiping engagement with the floor 2. The dashed lines surround the transmitter station 10, receiver station 11, power unit 12, necessary in a plough 1 for functionability, and a memory module if required. All these units are preferably accommodated in a common housing vibration damped, the common housing itself being additionally mounted in damped manner on rubber-metal connections. From the transmitter station 10 to the receiver station 11 a joint optical waveguide bundle 5 leads in a flexible sheath to the sensor head 3. The sensor head 3 scrapes with the end face 4 along the floor 2. The spring element D illustrated schematically will be described in detail with the aid of an example of embodiment in FIG. 4.

As however already indicated in FIG. 1 within the sensor head in dashed lines and shown fundamentally in detail in FIG. 2, at the exit of the sensor head 3 the optical waveguide bundle, that is the transmitting arm 5 or receiving arm 5' in conjunction with the crystal window 7 extends at an angle of 30 degrees to the floor 2. The eye 19 receiving the optical waveguide bundle 5 in the form of a transmitting arm in which the individual fibers of the different wavelengths are statistically mixed receives the optical waveguide bundle 5' of the receiving arm concentrically about the optical waveguide bundle 5 and bears flush on the crystal window 7. The arrows indicated within the crystal window show that the substantial reflection undesirably caused by the lower surface of the crystal window 7 is deflected to the side and thus only part of the troublesome reflection is picked up by the receiving arm 5'. FIG. 3 shows a view of the sensor head 3 seen from the conveyor means. The sensor head 3 is shown in section at least in the left half of the Figure. Provided in the end face 4 of the sensor head 3, which is guided wipingly along the floor 2, is a recess 24 in which a measuring insert 25 can be detachably inserted. The measuring insert 25 is held via two screws 35 in corresponding bores 36, one of said screws being shown Within the sensor head 3 the optical waveguide bundles extend within a protective flexibly formed sheath 14. Within the sensor head 3 the sheath 14 receiving the optical waveguide bundles 5, 5' is provided at the lower end 15 with a plug-type insert 17. The optical waveguide bundles 5, 5' terminate in the plug-type insert 17 as already indicated in the basic sketch of FIG. 2 in an eye 19. For locking the optical waveguide bundles at the bending point 48 an intermediate plug 18 is provided The lower plug-type insert 17 is secured dust-tight within the insert 25 by means of a special flange arrangement and with the aid of an O ring 46.

The measuring insert 25 consists of two parts detachably connectable together, the wear plate 26 and the wear plate holder 27. Before the measuring insert 25 is mounted scavenging shoes 39 may be attached at the narrow sides of the sensor head 3 in the respective travelling direction. The scavenging shoes are mounted with the aid of countersunk screws 40 from the recess 24 for the measuring insert and can be replaced when correspondingly worn.

The measuring insert 25 is shown in detail in FIGS. 5 to 8. The wear plate 26 of the measuring insert 25 comprises a flat portion 30 and a portion with greater dimensions 31, the two portions 30, 31 being joined together by an inclined surface 32. In the inclined surface 32 at an angle of 20 to 45 degrees, preferably however at an angle of 30 degrees, a bore 33 is provided which merges in widened form into a recess 22 receiving the crystal window 7. The wear plate holder 27 aligning in the assembled state with the wear plate 26 comprises a stepped bore 34 of which the axis lies in the axis of the bore 33 within the wear plate 26. As apparent from the plan views according to FIGS. 7 and 8 the two parts 26, 27 forming the measuring insert are connected together by countersunk screws 28 in correspondingly provided bores 29. In this manner the wear plate 28, which is subject to high wear, can rapidly be replaced if required.

The crystal window 7 has fundamentally the form shown in FIG. 2 and is stuck into the recess 22 The crystal window 7 terminates in front of the step defining the bore 33. The sensor head 3 arranged near the conveyor means on the coal plough 1 and guided wipingly along the floor 2 is made step-like towards the conveyor means, seen in cross-section, as is apparent from FIG. 4, and provided with a guard plate 38. The sensor head 3 is made from resistant and low-wear material such as hardened steel and is pressed against the floor 2 with respect to a sensor head holder 41 via a spring element 9 In the example of embodiment shown in FIG. 5 the spring element 9 consists of for example three guide pins 42 arranged adjacent each other in the travelling direction, the center of which is formed as biasing screw which is surrounded by biasing springs 43 and guided with its ends 44 in bores 45 of the sensor head 3. In contrast to the guide pins the biasing screw with the screw head can give way upwardly.

In FIG. 9 in a diagram the measurement results of the spectral general measurements are combined and represented graphically It can be seen therefrom that the adjacent rocks for all colours or wavelengths reflect to a considerably greater extent than coal. Another difference is that the reflection of adjacent rock increases almost uniformly with increasing wavelength. The reflection of coal however remains relatively constant in the visible region of the spectrum and in the center region rapidly rises to twice its value. This fact permits reliable interpretation of the measurement signals.

I claim:

1. Apparatus for detecting the cutting horizon for mining machines by detecting the position of the coal-rock interface with the aid of light signals of selected wavelengths applied to a mine surface having a sensor head adapted to be guided along and dragged across said mine surface, optical waveguide bundles constructed as measured valued pickups connected to said sensor head, a passage in said sensor head adapted to receive said optical waveguide bundles and having a lower end sealed with a crystal window, a transmitter station mounted on said mining machine and connected to one portion of said optical waveguide bundles, a receiver station mounted on said mining machine and connected to the other portion of said optical waveguide bundles: characterized in that the passage adapted to receive the optical waveguide bundles extends into the exit of said sensor head to mount the lower end of said waveguide bundles at an angle greater than 20 degrees but less than 45 degrees with respect to the mine surface and wherein said crystal window has a lower surface which extends parallel to the floor.

2. Apparatus according to claim 1, further characterized by a flexible sheath which surrounds said optical waveguide bundles within said sensor head and the lower ends of said sheath terminate in plug-type inserts in the form of eyes which receive the lower ends of said optical waveguide bundles.

3. Apparatus according to claim 2, further characterized by said optical waveguide bundles having a plurality of individual fibers with a diameter of approximately 70 μm, said portion of said optical waveguide bundles which connects to said transmitter station utilizing wavelengths of 850 nm and 1550 nm, said portion of said optical waveguide bundles which connects to said transmitter portion having an upper end which connects to a pair of eyes in a plug-type insert and said portion of said optical waveguide bundles which connects to said receiver station having an upper end which connects to a third eye.

4. Apparatus according to claim 2, further characterized by said optical waveguide bundles having a plurality of individual fibers, said individual fibers in the portion of said optical waveguide bundles which connects to said transmitter station utilize wavelengths of 850 nm and 1550 nm, are statistically mixed and have lower ends which connect to an eye in a plug-type insert in said sensor head and wherein said individual fibers in the portion of said optical waveguide bundles which connects to said receiver station are disposed concentrically around said individual fibers connected to said transmitter station.

5. Apparatus according to claim 1, further characterized by said sensor head having a recess for receiving said crystal window, where said crystal window has a first side which faces said optical waveguide bundle and a second side which faces said mine surface and said first and second sides of said crystal window are ground and polished.

6. Apparatus according to claim 3, further characterized by one of a light-emitting diode or a laser diode providing a source of light for the wavelengths of 850 nm and 1550 nm.

7. Apparatus according to claim 6, further characterized by said apparatus providing an evaluation signal corresponding to a mathematical ratio R as follows:

$$R\ (\text{ratio}) = \frac{\text{measuring signal 850 nm} - \text{scattering level 850 nm}}{\text{measuring signal 1550 nm} - \text{scattering level 1550 nm}}$$

8. Apparatus according to claim 1, further characterized by said sensor head having a recess formed in the end face adapted to receive a measuring insert and wherein said measuring insert mounts said crystal window.

9. Apparatus according to claim 8, further characterized in that said measuring insert includes a wear plate holder and a wear plate.

10. Apparatus according to claim 9, further characterized by screws fastening said wear plate to said wear plate holder.

11. Apparatus according to claim 9, further characterized by said wear plate having a pair of offset flat surfaces joined by an inclined surface, wherein the angle of said inclined surface with respect to said mine surface is greater than 20 degrees but less than about 45 degrees, a crystal bore is formed in said wear plate perpendicular to said inclined surface and said crystal window is mounted in said crystal bore.

12. Apparatus according to claim 11, further characterized by said wear plate holder having a pair of offset flat surfaces joined by an inclined surface, a stepped bore is formed in said wear plate perpendicual to said inclined surface and said stepped bore is concentric with said crystal bore in said wear plate.

13. Apparatus according to claim 8, further characterized by mounting screw for attaching said measuring insert to said sensor head.

14. Apparatus according to claim 1, further characterized by a pair of scavenging shoes mounted on each side of said sensor head in the direction of travel.

15. Apparatus according to claim 14, further characterized in that said scavenging shoes are connected detachably to said sensor head.

16. Apparatus according to claim 14, further characterized in that said scavenging shoes are connected detachably to said sensor head by screws.

17. Apparatus according to claim 1, further characterized by a sensor head holder for holding said sensor head, said sensor head holder includes spring means for biasing said sensor head against said mine surface and said sensor head is made from a wear-resistant material.

18. Apparatus according to claim 17, further characterized in that said sensor head holder spring means has a guide pin received in a bore in said sensor head and a spring which surrounds said guide pin.

* * * * *